United States Patent [19]

Sullivan

[11] Patent Number: 5,042,269

[45] Date of Patent: Aug. 27, 1991

[54] FAN COIL UNIT WITH SNAP SECURING FAN HOUSING

[76] Inventor: John T. Sullivan, 3910 Madison St., Hyattsville, Md. 20781

[21] Appl. No.: 459,222

[22] Filed: Dec. 29, 1989

[51] Int. Cl.[5] ..... F25D 21/14

[52] U.S. Cl. ..... 62/285; 62/272; 415/214.1; 415/213.1; 285/319; 403/280; 403/DIG. 4

[58] Field of Search ..... 62/285, 272; 415/213.1, 415/214.1; 285/319; 403/280, 282, DIG. 4, 329

[56] References Cited

U.S. PATENT DOCUMENTS 3,491,550 1/1970 Cavis ..... 62/285
4,599,042 7/1986 Colliver ..... 415/214.1
4,823,558 4/1989 Kim ..... 62/285

FOREIGN PATENT DOCUMENTS 1173895 12/1969 United Kingdom ..... 285/319

*Primary Examiner*—Henry A. Bennett
*Assistant Examiner*—John Sollecito
*Attorney, Agent, or Firm*—Diller, Ramik & Wight

[57] ABSTRACT

A pan and fan housing assembly for a fan coil unit includes a primary pan having a wall defining an air passage through which air is directed by a fan in a fan housing powered by a motor. The fan housing is formed of two fan housing bodies snap-secured to each other and snap-secured to the primary pan air passage defining wall.

29 Claims, 7 Drawing Sheets

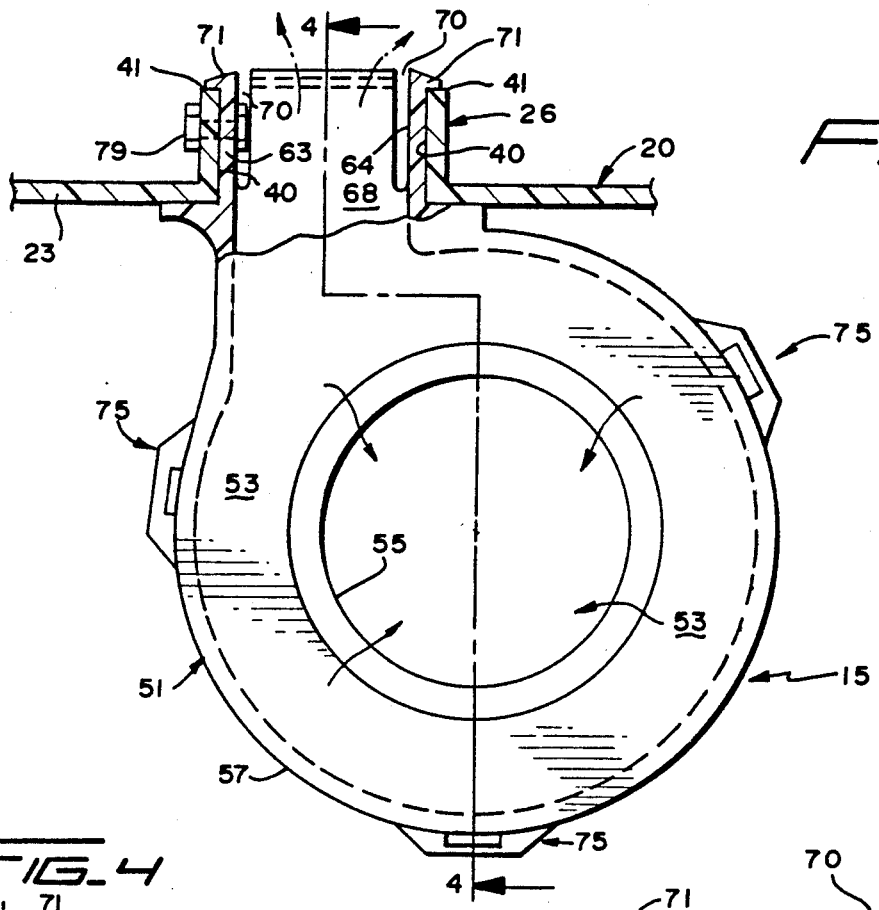
FIG. 3
FIG. 4
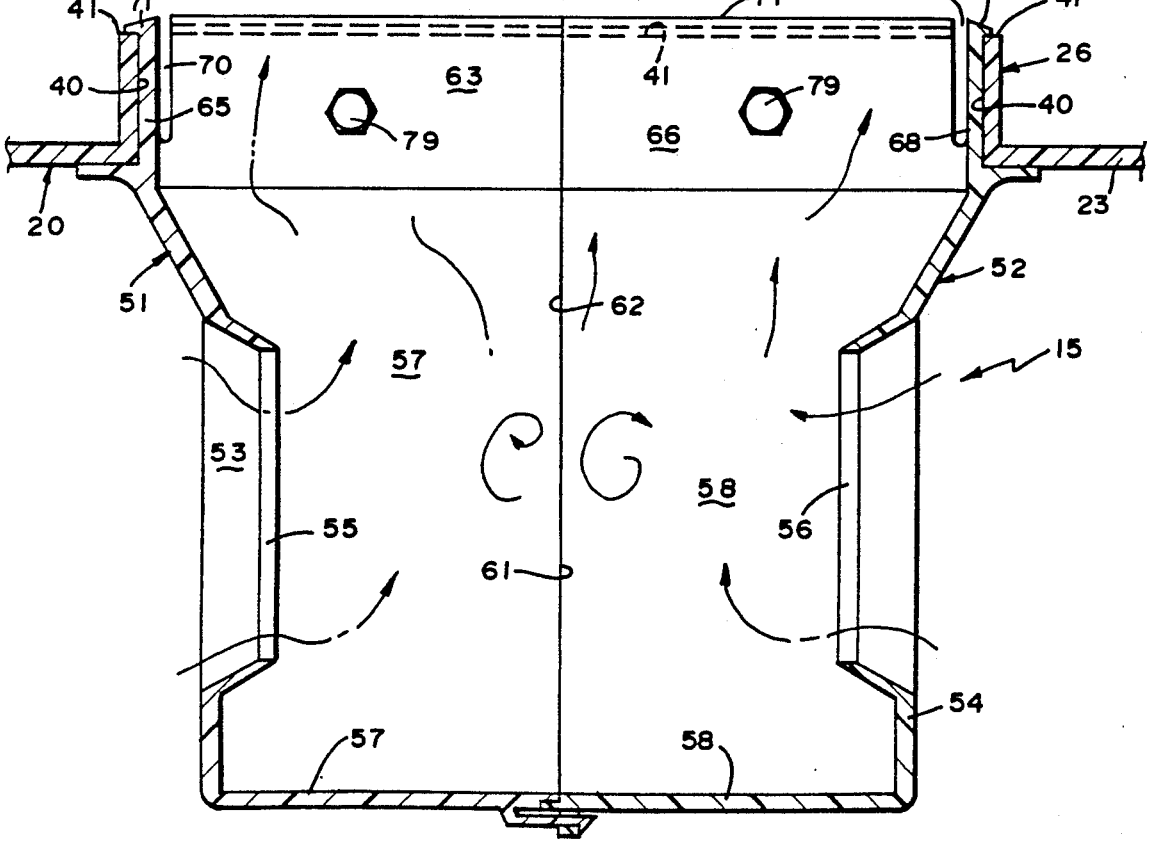

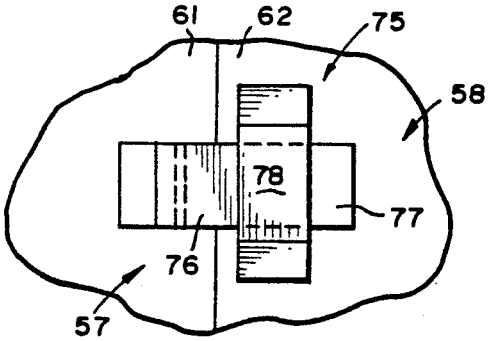
FIG. 6
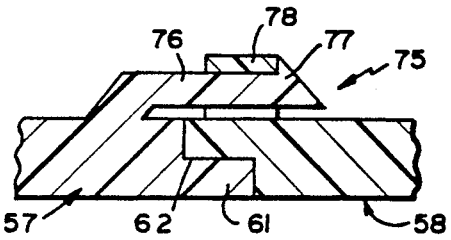
FIG. 5
FIG. 7
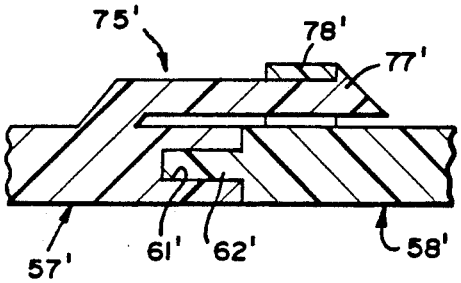
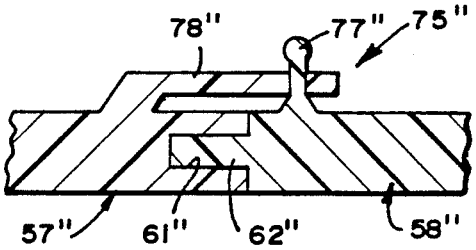
FIG. 8
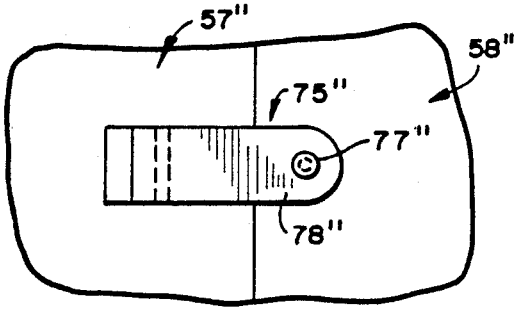
FIG. 9
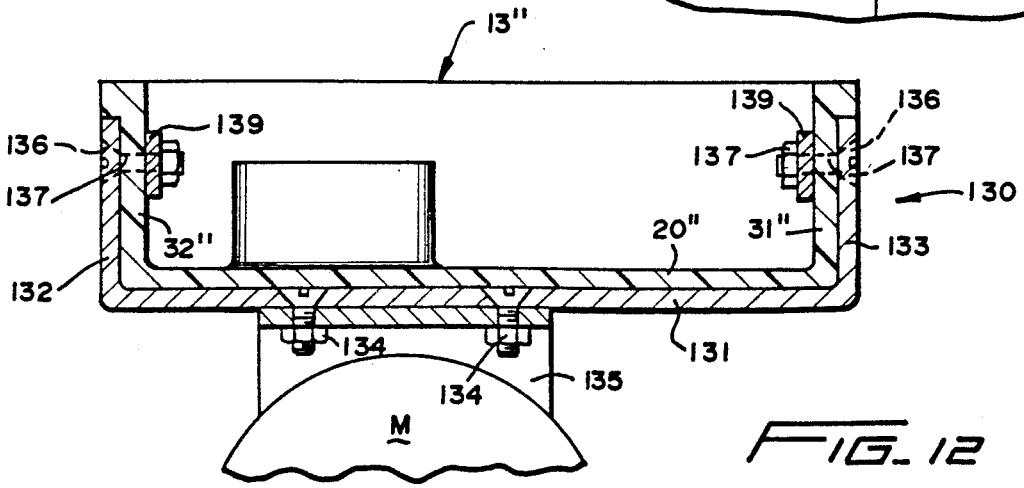
FIG. 12

FAN COIL UNIT WITH SNAP SECURING FAN HOUSING

CROSS-REFERENCE TO RELATED APPLICATIONS

This invention is directed to a fan coil unit for commercial and residential air conditioners which can utilize a primary pan or convector tray of the type disclosed in U.S. Pat. No. 4,856,672 granted on Aug. 15, 1989 and application Ser. No. filed on Dec. 1, 1989, entitled A FAN COIL UNIT, both in the name of John T. Sullivan.

BACKGROUND OF THE INVENTION

Residential and commercial air conditioners include as a part thereof a fan coil unit located within a housing which includes a coil through which refrigerant (liquid or gas) is pumped. The coil is normally supported above a condensation pan, convector tray or primary pan having one or more openings through which air is blown by one or more fans powered by motors which are supported below and from the primary pan. The air passing through the coil creates condensation on the coil which drips down upon the primary pan and is then conducted by an appropriate outlet and a discharge pipe to a secondary pan and an associated drain.

Such conventional primary pans are generally made from galvanized metal and rust with relative ease. Once the primary pan rusts, the condensation/water normally accumulating therein and draining properly therefrom can, for example, drip down into the underlying motor(s) which drives the fan(s) thereby causing the motor to short-out. Excessive rust also blocks or reduces normal drainage which results in fungus growth and fungus growth in turn can cause odors. Obviously, should such fungus growth cause the normal drain opening of the primary pan to close or become appreciably blocked, the water/condensation will overflow with attendant damage.

The latter-identified patent and pending patent application reduce rust and fungus growth associated with conventional galvanized metal primary pans. The latter patent and patent application also provide an unobvious solution to rubber gasket deterioration associated with conventional primary pans through the utilization of a thin flexible fan-folded water impermeable sheet position between the primary pan and the coil. Primary pan reinforcement, motor mounts and fan housing mounts are also set forth in the latter-identified disclosures.

SUMMARY OF THE INVENTION

The present invention is directed to further novel and innovative structural aspects of a fan coil unit which overcomes the disadvantages heretofore noted by not only providing a primary pan constructed from in situ molded polymeric/copolymeric material, but also providing in association therewith novel means for pivotally connecting the primary pan adjacent a front wall thereof relative to an associated fan coil unit.

Because of the novel pivot means, which is preferably a pair of downwardly opening slots one at each of lateral side walls of the primary pan, the fan motor, fan housings and fans can be secured to the primary pan to form a unitary pan and fan housing assembly therefrom, and the pan and fan housing assembly can be unitarily inserted into the fan coil unit, pivoted to an operative position and locked thereat. Due to this construction, the pan and fan housing assembly can be unitarily quickly inserted into an associated fan coil unit and similarly removed therefrom.

In further accordance with the present invention, a fan housing of the pan and fan housing assembly is formed of at least two fan housing bodies, and means are provided for snap-securing the fan housing bodies to a peripheral wall defining at least one air passage in a bottom wall of the primary pan through which air from an associated fan is directed toward a coil.

In a preferred embodiment of the invention, the primary pan has two air passages, each is defined by an upstanding peripheral wall, and each fan housing is snap-secured to an associated peripheral wall. A motor housing is conventionally positioned between the fan housings, and the motor housing is also preferably connected to an underside of the bottom wall of the primary pan. Due to the latter overall mounting, the motor housing is rigidly connected to the primary pan bottom wall as are the fan housings. Thus, normal or excessive vibration which might occur as the fan motor is energized and de-energized, causing vibration will not adversely affect the fan housings and motor housing mountings. Furthermore, since none of the mountings rely upon the use of fasteners which pass through holes of the primary pan opening into the condensation chamber thereof, as is conventional in the prior art, deterioration of associated mounting fasteners is precluded, and this additionally assures reliable operation and long life of the motor housing and fan housing mountings.

In further accordance with the present invention, the fan housing is preferably constructed from two generally mirror fan housing bodies, and means are also provided at peripheral abutting edges of the fan housing bodies for snap-securing the same to each other. Preferably, the snap-securing means are in the form of male fasteners received in female slots/openings of the fan housing bodies.

In further accordance with this invention, the primary pan also has an upper peripheral edge upon which is mounted a relatively large tubular gasket which contacts the interior surfaces of the coil unit housing walls. The gasket thereby forms not only a seal against air and moisture flow, but effectively provides a "cold" sink preventing the formation of condensation at the downstream side of the coil with an attendant reduction of the formation of condensation thereat. The less condensation formed at the downstream side of the coil, the less damage that can be done by the condensation/water as it collects/flows toward the drain opening. Thus, the "cold" sink minimizes downstream condensation formation while maximizing upstream condensation formation which in turn automatically decreases the residence time of the condensation in the primary pan and in turn lessens such objectionable characteristics as fungus growth.

With the above and other objects in view that will hereinafter appear, the nature of the invention will be more clearly understood by reference to the following detailed description, the appended claims, and the several views illustrated in the accompanying drawings.

BRIEF DESCRIPTION OF THE DRAWINGS

FIG. 3 is an enlarged end elevational view of the fan housing of FIG. 2 with parts broken away for clarity, and illustrates the manner in which the fan housing is snap-secured to a peripheral wall bounding an air passage of the primary pan.

FIG. 4 is an enlarged cross-sectional view taken generally along line 4–4 of FIG. 3, and illustrates the manner in which the fan housing is formed of two fan housing bodies snap-secured together along opposing abutting mating edges.

FIG. 5 is an enlarged fragmentary cross-sectional view of one of several male and female fasteners carried by the fan housing bodies, and illustrates the manner in which same are snap-secured together.

FIG. 6 is a fragmentary top plan view of the securing means of FIG. 5, and illustrates details thereof.

FIG. 7 is fragmentary cross-sectional view of male and female fasteners similar to FIG. 5, and illustrates a tongue of a peripheral edge of one of the fan housing bodies being received in a groove of a peripheral edge of the other of the fan housing bodies.

FIG. 8 is a fragmentary sectional view similar to FIG. 7, and illustrates another male and female fastener for securing the fan housing bodies to each other.

FIG. 9 is a fragmentary top elevational view of the fasteners of FIG. 8, and illustrates details thereof.

FIG. 12, which appears on the sheet of drawings containing FIGS. 5 through 9, is a fragmentary cross-sectional view through another primary pan, and illustrates a generally U-shaped motor mounting bracket secured to an exterior of the primary pan and a pair of reinforcing members extending generally the length of associated front and rear walls of the primary pan.

DESCRIPTION OF THE PREFERRED EMBODIMENT

Figure 1:
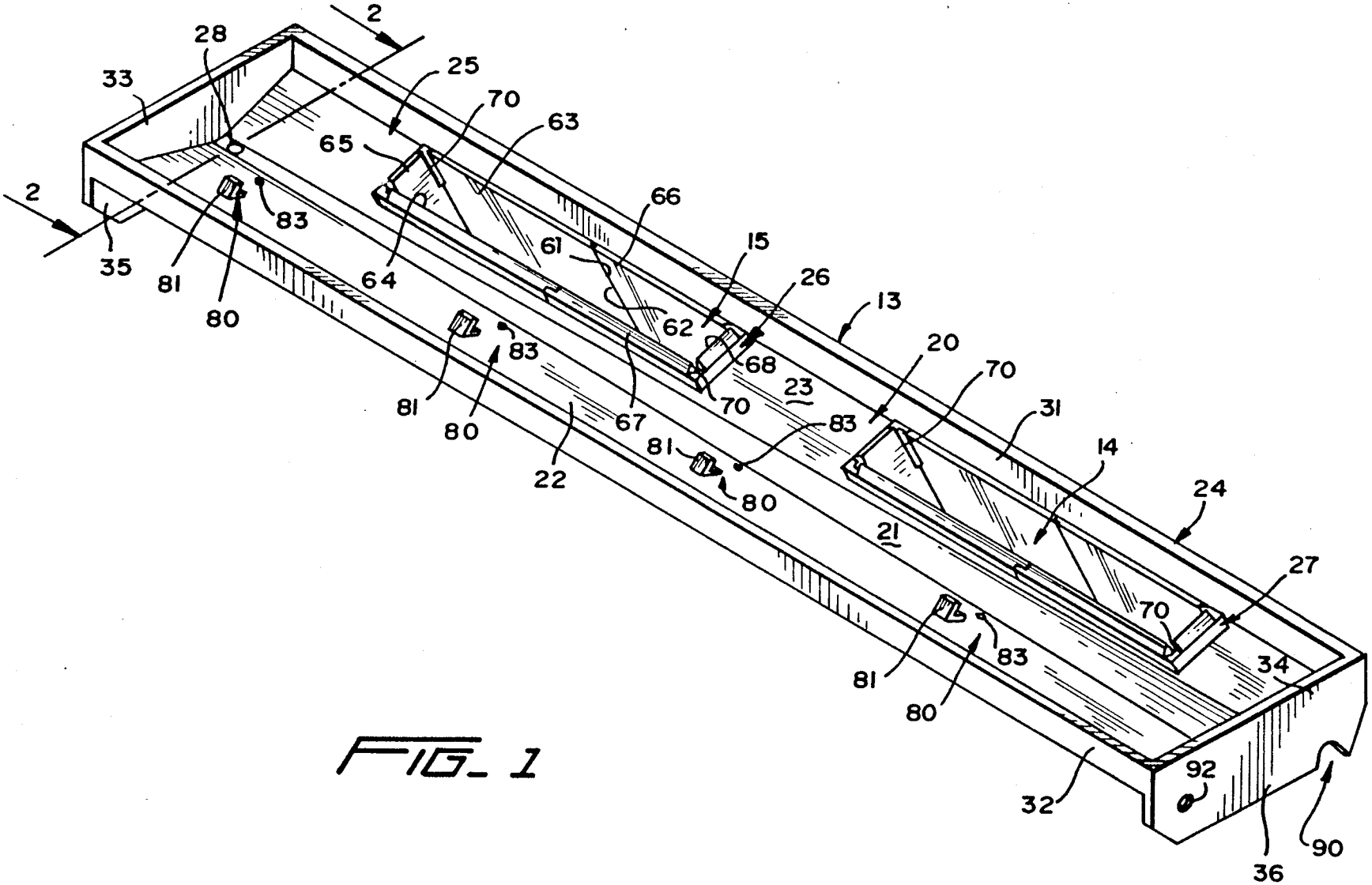
FIG. 1 is a top perspective view of a novel condensation pan or primary pan of the present invention, and illustrates a bottom wall having a pair of air passages each defined by an upstanding peripheral wall and each having snap-secured thereto split fan housings each defined by a pair of fan housing bodies.
Figure 10:
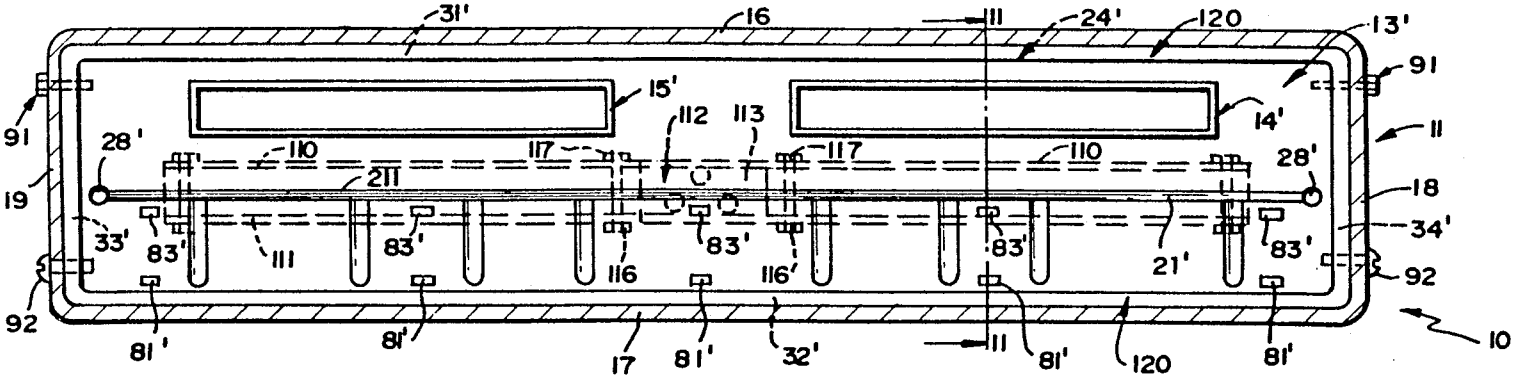
FIG. 10 is a horizontal cross-sectional view through a fan coil unit housing, and illustrates another primary pan of the present invention located therein.
Figure 2:
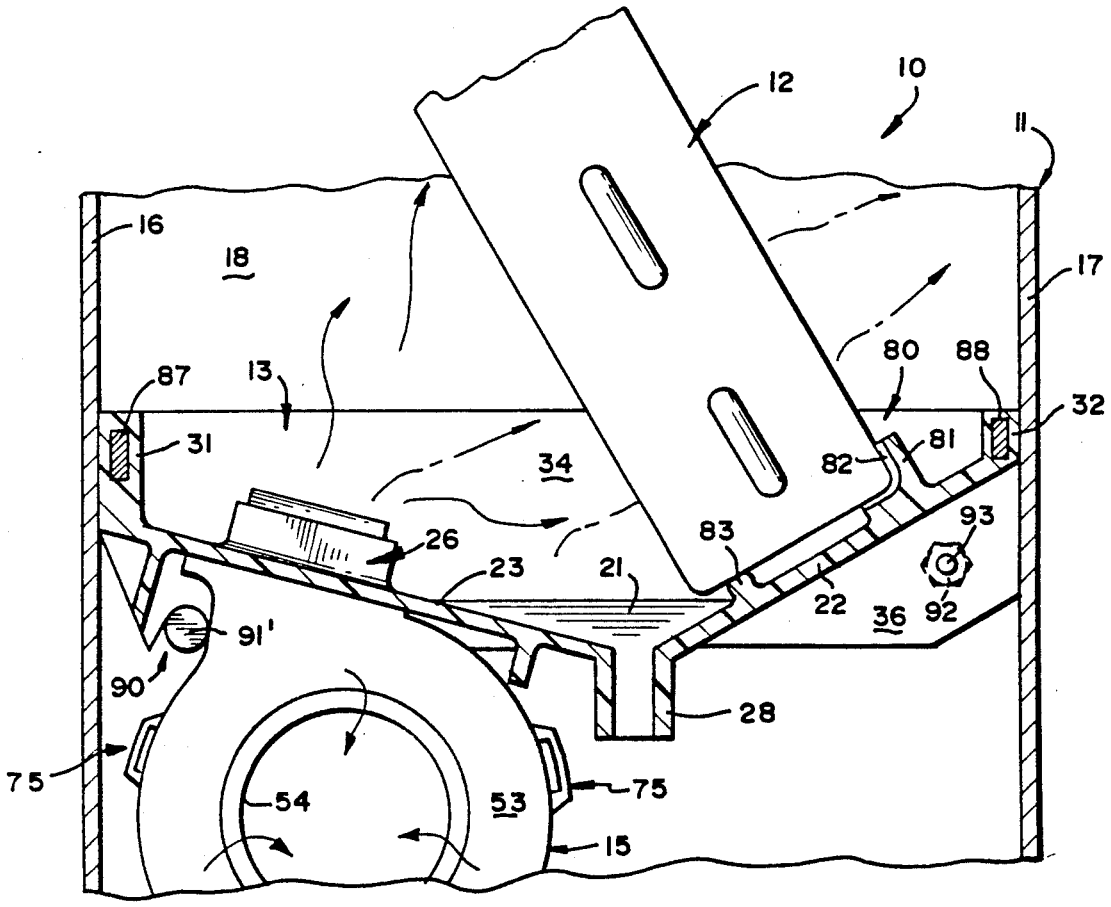
FIG. 2 is an enlarged fragmentary cross-sectional view taken generally along line 2–2 of FIG. 1, and illustrates one of the fan housings, a coil located relative to the bottom wall, reinforced front and rear walls of the primary pan, and the pivotal mounting of the primary pan to pivots carried by lateral walls of a fan coil unit housing.

A novel fan coil unit of the present invention is illustrated in FIG. 2 of the drawings and is generally designated by the reference numeral 10. The fan coil unit 10 includes a housing 11, a condensation/evaporation coil 12, a primary pan, condensation pan or convector tray 13, and a pair of fan housings 14, 15 (FIG. 1) in each of which is mounted a fan (not shown). The housing 11 is fully illustrated in the latter-identified application, and the totality of the disclosure relative thereto is incorporated herein by reference. The housing 11 includes a generally vertical upstanding front wall 16 (FIGS. 2 and 10), a rear wall 17 parallel thereto, and opposite generally parallel lateral or side walls 18, 19 (FIG. 10). The coil 12 is conventionally supported within the housing 11, and in accordance with the present invention, upon the removal of the rear wall 17 from the overall fan coil unit 10, the primary pan 13 with the fan housings 14, 15 and the fan motor housing (not shown) secured to the primary pan 13 are so constructed and arranged as to be unitarily removed from and/or inserted in the housing 11 in a novel manner, as will be described more fully hereinafter.

The primary pan 13 is formed from in situ molded polymeric/copolymeric plastic material, and includes a bottom wall 20 having a central elongated bottom wall portion 21 to either side of which are lateral bottom wall portions 22, 23. The bottom wall 20 of the primary pan 13 merges with an upstanding peripheral wall 24 and defines with two other upstanding peripheral walls 26, 27 a condensation chamber 25 into which condensation formed as air passes through the coil 12 (FIG. 2), collects and drains through a generally tubular drain opening 28 (FIG. 2). The upstanding peripheral wall 24 is defined by a relatively long front wall 31, a relatively long rear wall 32 parallel to the front wall 31, and opposite upstanding relatively short lateral or side walls 33, 34 having respective lower edge portions 35, 36. The lateral bottom wall portions 22, 23 converge downwardly toward each other and merge with the central elongated bottom wall portion 21. The central elongated bottom wall portion 21 converges in a direction from the side wall 34 to the side wall 33 and also slants downwardly in the same direction, as is readily apparent from FIGS. 1 and 2. Thus, the primary pan 13 is "dedicated" for drainage of condensation from right-to-left, as viewed in FIG. 1, in the condensation chamber 25 toward the drain outlet 28.

Each of the peripheral walls 26, 27 is of a generally rectangular configuration, as viewed from above (FIG. 1), and each includes an inner surface 40 (FIGS. 3 and 4) and an upper peripheral edge 41. For purposes of this description, each inner surface 40 of each upstanding peripheral wall 26, 27 defines an air passage through the lateral bottom wall portion 23 of the bottom wall 20 through which air is conducted/blown by a fan (not shown) associated with each of the fan housing 14, 15 in the manner indicated by the unnumbered headed arrows in FIGS. 2 through 4 of the drawings.

The fan housings 14, 15 are identical and, therefore, the following description of the fan housing 15 is equally applicable to the fan housing 14. The fan housing 15 is formed of at least two fan housing bodies 51, 52 having respective generally circular end walls 53, 54; generally circular air inlets 55, 56 formed therein, and generally cylindrical peripheral walls 57, 58 terminating in respective abutting peripheral edges 61, 62. The peripheral wall 57 progressively converges at an upper end into an upper front wall portion 63, an upper rear wall portion 64 parallel thereto, and an upper side wall portion 65 between the portion 63, 64, as is best shown in FIG. 1. Similarly, the peripheral wall 58 merges upwardly into an upper front wall portion 66, an upper rear wall portion 67 parallel to the upper front wall portion 66, and an upper side wall portion 68 between the wall portion 66, 67. Upwardly opening notches, slots or grooves 70 are formed at the intersections of the upper wall portions 63, 65; 64, 65; 66, 68; and 67, 68 which render the upper wall portions 63 through 68 relatively deflectable and flexible. Each of the upper wall portions 63 through 68 terminates in an outwardly directed tongue or lip 71 which can snap engage over and upon the upper peripheral edges 41 of the peripheral walls 26, 27 in the manner illustrated in FIGS. 3 and 4 in a manner which will be described more fully hereinafter.

The peripheral edges 61, 62 of the respective peripheral walls 57, 58 are stepped in mirror image to each other to maintain the fan housing bodies 51, 52 in accurate assembled relationship, and the latter relationship is maintained by snap-securing means or fastening means 75 (FIGS. 3 through 6) defined by a male fastening member 76 in the form of an elongated tongue having a hook 77 which passes through a female fastening member or loop 78 and locks therewith in a manner evident from FIGS. 5 and 6 of the drawings. Obviously, when the fan housing bodies 51, 52 are to be disassembled, the tongues 71 are deflected downwardly to release the hook 77 from the loop 78 to effect disassembly, whereas reassembly is, obviously, accomplished in the reverse fashion. However, once the fan housing bodies 51, 52 have been snap-secured to each other by the securing or fastening means 75, the inadvertent or accidental disassembly thereof is virtually precluded. Furthermore, when thus assembled, the upper wall portions 63 through 68 are simply inserted upwardly from the bottom through the air passage 40 defined by the upstanding peripheral wall 26 and/or 27. The slots 70 allow the upper wall portions 63 through 68 to temporarily deflect inwardly as the tongues 71 move along the inner surface 40 of the peripheral walls 26, 27. However, after the tongues or lugs 71 pass the upper peripheral edges 41, the resilience of the material snaps the upper wall portions 63 through 68 to the "normal" configuration thereof at which time the tongues 71 overlie and abut the upper peripheral edges 41 of the peripheral walls 26 and 27. Though not considered necessary, bolts and nuts 79 (FIGS. 3 and 4) may be selectively utilized to additionally fasten any one or all of the upper wall portions 63 through 68 to the peripheral walls 26, 27.

The fan body housings 51, 52 are, of course, snap-secured to the primary pan 13 in the manner just described with the fans (not shown) housed therein. As will be noted from the latter-identified patent application, the fan motor housing supports a motor having a driven shaft projecting axially oppositely and carrying a fan at each end thereof. Each fan is, of course, housed in one of the fan housings 14, 15, and both the fan motor housing and the fan housings are assesmbled to the primary pan 13 before the primary pan 13 is assembled in the fan coil unit housing 11. In this manner the primary pan 13, the fan housings 14, 15, and the motor housing (not shown) define a unitary pan and fan housing assembly (unnumbered) which can be bodily inserted into and removed from the coil unit housing 11, in a manner which will be described more fully hereinafter.

The lateral bottom wall portion 22 (FIG. 1) of the primary pan 13 also includes a plurality of identical means 80 for locating against the bottom edge (unnumbered) of the coil 12, as is most apparent from FIGS. 1 and 2 of the drawings. The coil locating means 80 each includes a generally L-shaped abutment 81 having an inboard generally L-shaped groove or channel 82 and an upstanding projection 83. When the primary pan 13 is seated within the housing 11, as shown in FIG. 2, the bottom edge (unnumbered) of the coil 12 engages and is supported by the L-shaped abutment 81 and the projection 83. Furthermore, any condensation which might form on the upstream or right-hand side of the coil 12, as viewed in FIG. 2, and might collect upon any of the abutments 81 will drain through the channels 82. This is of particular importance should the individual four locating or abutment elements 80 be formed as a single continuous abutment member running the length of the primary pan 13. In such case, absent the channels 82, moisture/condensation might collect at the upstream side of the coil 12 creating fungus growth and/or odor.

Since the primary pan 13 also supports the coil 12 by the bottom edge of the coil 12 resting upon the abutments 80 and the projections 83, the primary pan 13 must be relatively rigid, particularly in its lengthwise direction. The latter is assured by providing the front and rear walls 31, 32, respectively, with metallic rigidifying or reinforcing members 87, 88, respectively. The members 87, 88 are molded in situ during the formation of the primary pan 13 or are slid in openings therein after the molding of the primary pan 13, as is described more fully in the latter-identified patent application.

The primary pan 13 also includes means generally designated by the reference numeral 90 (FIGS. 1 and 2) in the form of a downwardly opening slot in each lower edge portion 35, 36 of the respective lateral or side walls 33, 34 of the primary pan 13. The slots 90 are located so as to embrace pivot means in the form of a pivot pin 91 (FIGS. 2 and 10) in axial alignment with each other projecting inward relative to the housing end walls 18, 19. Assuming that the rear wall 17 of the housing 11 is removed and it is desired to insert the primary pan and fan assembly (13–15 and fan motor) therein, the primary pan 13 is inserted into the interior of the housing 11 from right-to-left, as viewed in FIG. 2, while holding the primary pan 13 in an inclined or tilted position with the front wall 31 higher than the rear wall 32. The primary pan 13 is then manipulated such that the slots 90 engage the pins 91 defining cooperable pivot means 90, 91 therebetween. Once the pins 91 have been embraced by the slots 90, the lower positioned rear wall 32 can be lifted upwardly to the position shown in FIG. 2 and means 92 in the form of a screw or bolt can be threaded into an opening 93 of each of the lower edge portions 35, 36 of the primary pan end walls 33, 34, respectively. The rear wall 17 of the housing 11 can then be reassembled and the operative condition of the overall fan coil unit 10 is as shown in FIG. 2. Obviously, this assembly and removal of the primary pan 13 is as easily accomplished by (a) removing the rear wall 12, (b) removing the bolts or screws 92, (c) pivoting the primary pan 13 clockwise, as viewed in FIG. 2, and (d) lifting the slots 90 free of the pivot pins 91 followed by the withdrawal of the primary pan, the fan housings 14, 15 and the motor as a unitary assembly from the interior of the coil unit housing 11.

Reference is made to FIG. 7 of the drawing which illustrates another example of a securing or fastening means 75' for securing together peripheral walls 57', 58' of the fan housing bodies. In this case, the fastening means 75' are identical to the fastening means 75 of FIGS. 5 and 6 but peripheral edges 61', 62' are formed as a respective outwardly opening groove and an outwardly projecting tongue. Thus, the peripheral edges 61', 62' afford more reliable interlocking of the peripheral edges 57', 58' than the edges 61, 62 of FIGS. 5 and 6.

FIGS. 8 and 9 are another example of a fastening means 75'' in which a male fastener 77'' has an enlarged head (unnumbered) which projects through an opening (unnumbered) of a female fastener 78''.

Figure 11:
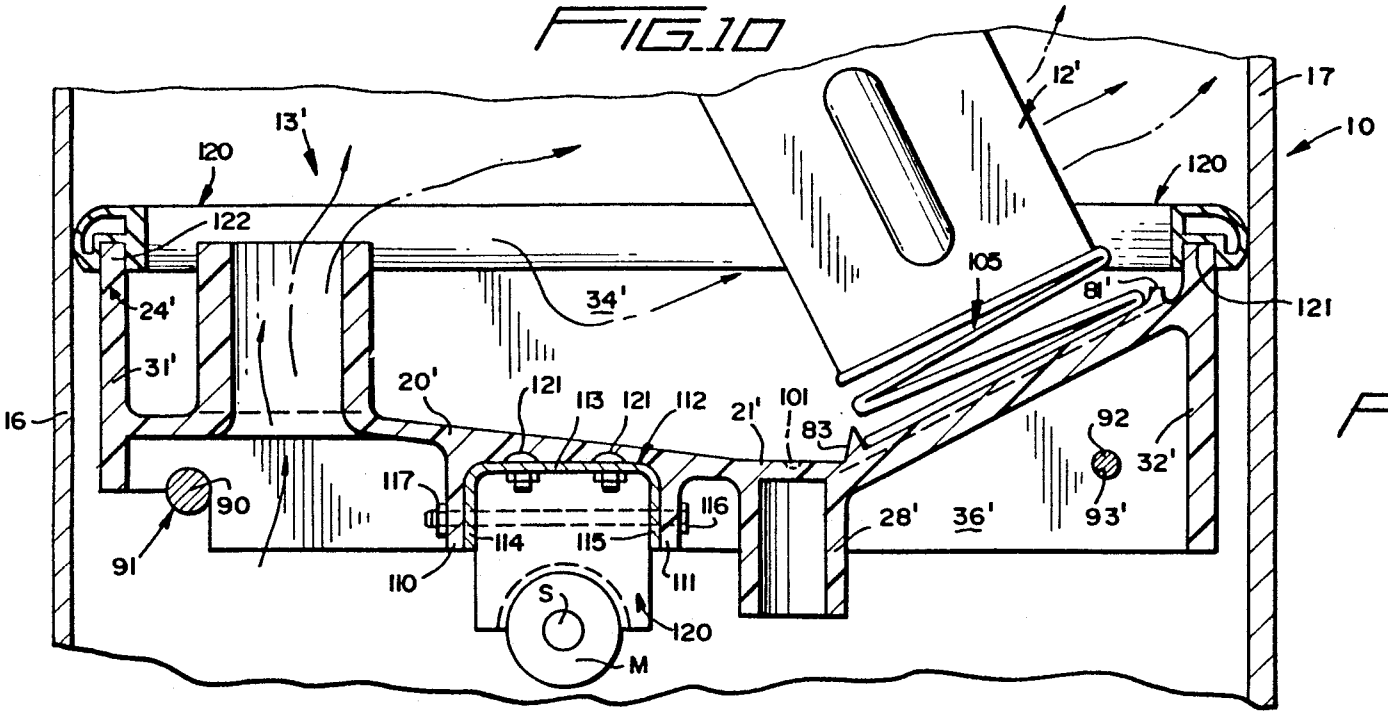
FIG. 11 is an enlarged fragmentary cross-sectional view taken generally along line 11–11 of FIG. 10, and illustrates the primary pan carrying an enlarged tubular gasket at an upper peripheral wall thereof and a pair of fan motor mounting walls depending from a bottom wall of the primary pan.

Another novel primary pan constructed in accordance with this invention is illustrated in FIGS. 10 and 11 of the drawings, and the structure corresponding to that of the primary pan 13 has been identically numbered, though primed.

In accordance with the embodiment of the invention illustrated in FIGS. 10 and 11, a primary pan 13' includes a front wall 31', a rear wall 32', and lateral or side walls 33', 34' having respective lower edge portions 35', 36', each including a slot 90' and a bore 93' associated with the respective pivot pins 91 and screws or bolts 92 (FIG. 10) of the fan coil unit housing 11. A bottom wall 20' also includes two air passages (unnumbered) bounded by peripheral walls 14', 15' and a central elongated bottom wall portion 21' which, however, is not inclined and communicates with a closed drain spout or outlet 28' at opposite ends of the primary pan 13'. A wall portion (unnumbered) above each drain spout 28' is provided with an upwardly opening recessed or dimple 101 which can be used to center a drill bit for removing either wall portion to open one of the drain spouts 28', 28' for either left-to-right or right-to-left drainage. The bottom wall 20' also includes pairs of upwardly directed abutments or projections 81', 83' which position therebetween means 105 in the form of a water impermeable fan-folded sheet metal membrane which prevents air, indicated by the unnumbered headed arrows in FIG. 11, from passing between a lower edge (unnumbered) of the coil 12' and the bottom wall 20'. Instead, the air is forced to flow directly through the coil 12'.

The bottom wall 20' of the primary pan 13' also includes two integral in situ molded fan motor mounting walls 110, 111 which are in generally parallel relationship to each other and extend virtually the length of the primary pan 13', terminating short of the outlets 28', as is most readily apparent in FIG. 10. A generally inverted U-shaped motor mounting bracket 112 is defined by a bight 113 and a pair of legs 114, 115. A plurality of relatively long bolts 116 and associated nuts 117 secure the legs or arms 114, 115 of the U-shaped bracket 112 to the motor mounting walls 110, 111. However, before the latter takes place, a generally inverted U-shaped bracket 120 is connected by nuts and bolts 121 to the bight 113 of the U-shaped bracket 112. The inverted U-shaped bracket 120 includes a pair of downwardly depending legs of which only a leg 122 is illustrated. The leg 122 is connected to another parallel leg (not shown) by a bight wall (unnumbered) normal thereto, and it is this bight wall which is connected by the nuts and bolts 121 to the bight 113. The leg 122 and the opposite leg parallel thereto of the bracket 120 is connected to a motor housing M having a shaft S projecting axially outwardly from opposite ends thereof which in turn carries the fans and the fan housings, the latter being unillustrated, but corresponding to the fan housings 14, 15. Accordingly, the motor M, the shaft S thereof, the fans (not shown), and the fan housings (generally 14, 15) are carried by the bracket 120 which is in turn connected to the bight 113 of the U-shaped bracket 112. This entire assembly is then mounted to the primary pan 13' by inserting the bracket 112 between the motor mounting walls 110, 111 and fastening the same in place by the bolts 116 and the nuts 117. In this case, the front and rear walls 31', 32' are not reinforced since the U-shaped bracket 112 functions not only to mount the fan and motor assembly in position but also reinforces the primary pan 13' along the length thereof.

The primary pan 13' also carries gasket means 120 in the form of a relatively large tubular gasket which has a groove 121 fitted upon and adhesively bonded to an upper peripheral edge 122 of the peripheral wall 24'. Normally if the peripheral wall 24' contacted walls 16 through 19 of the housing 11, a relatively "cold" thermal sink would create excessive condensation at the upstream air side of the coil 12', but this is precluded by the relatively large and tubular gasket 120 which, therefore, not only forms an air seal above and below the primary pan 13', but also effects thermal insulation between the housing walls 16 through 19 and the primary pan 13'.

Another novel primary pan 13'' constructed in accordance with this invention is illustrated in FIG. 12, and like portions thereof corresponding to those of the primary pan 13 have been identically numbered, though double primed. The primary pan 13'' carries a generally U-shaped motor mounting bracket 130 defined by a bight 131 and upstanding arms 132, 133. The bracket 130 is in external bracing relationship to a bottom wall 20'', a rear wall 32'' and a front wall 31'' of the primary pan 13''. Nuts and bolts 134 secure a motor mounting bracket 135 carrying a fan motor M to the bight 131 of the bracket 130. Similar bolts, screws and nuts 136 connect the legs 132, 133 to the respective walls 32'', 31'' through openings 137 formed therein. However, the openings 137 are well above the bottom wall 20'' and, therefore, are not adversely affected by condensation collecting in the primary pan 13''. Furthermore, the nuts and bolts 136 also connect elongated reinforcing members 139 to an inner surface (unnumbered) of the walls 31'', 32'' along virtually the entire length thereof. Hence, the same nuts and bolts 136 which connect the U-shaped bracket 130 to the primary pan 13'' also connect the reinforcing members 139 thereto.

Figure 13:
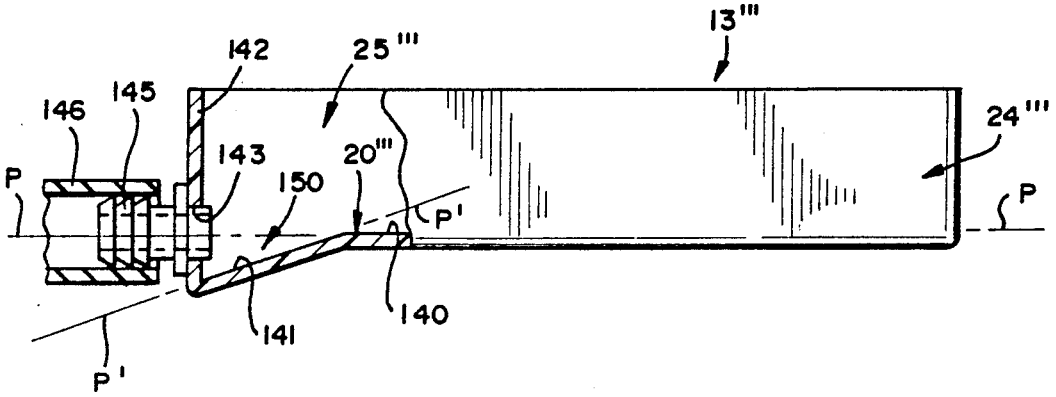
FIG. 13 is a side elevational view with a portion thereof broken away for clarity of another primary pan of the present invention, and illustrates a downwardly stepped reservoir of the primary pan in fluid communication with a drain tube.

In FIG. 13 of the drawings a primary pan 13''' is illustrated which includes a peripheral wall 24''' defining a condensation chamber 25'''. A bottom wall 20''' of the primary pan 13''' includes a major interior surface or wall 140 which spans virtually the entire bottom wall area of the condensation chamber 25''' except for a minor interior surface or wall 141 which is immediately adjacent a portion 142 of the peripheral wall 24''' having a circular opening 143 therein. The drain opening 143 has a lowermost edge (unnumbered) which is below a plane P—P of the major interior surface 140 and which is also at least partially above a plane P'—P' of the minor interior surface 141. The planes P—P and P'—P' define a generally acute angle relative to each other which opens in a direction toward the drain opening 143 which houses a tubular drain fitting 145 connected to a drain pipe 146. The minor interior surface 140 thereby defines a minor reservoir 150 below the plane P—P into which condensation will drain from the major interior surface 140 incident to passing through the tubular drain fitting 145 and the drain pipe 146.

Figure 15:
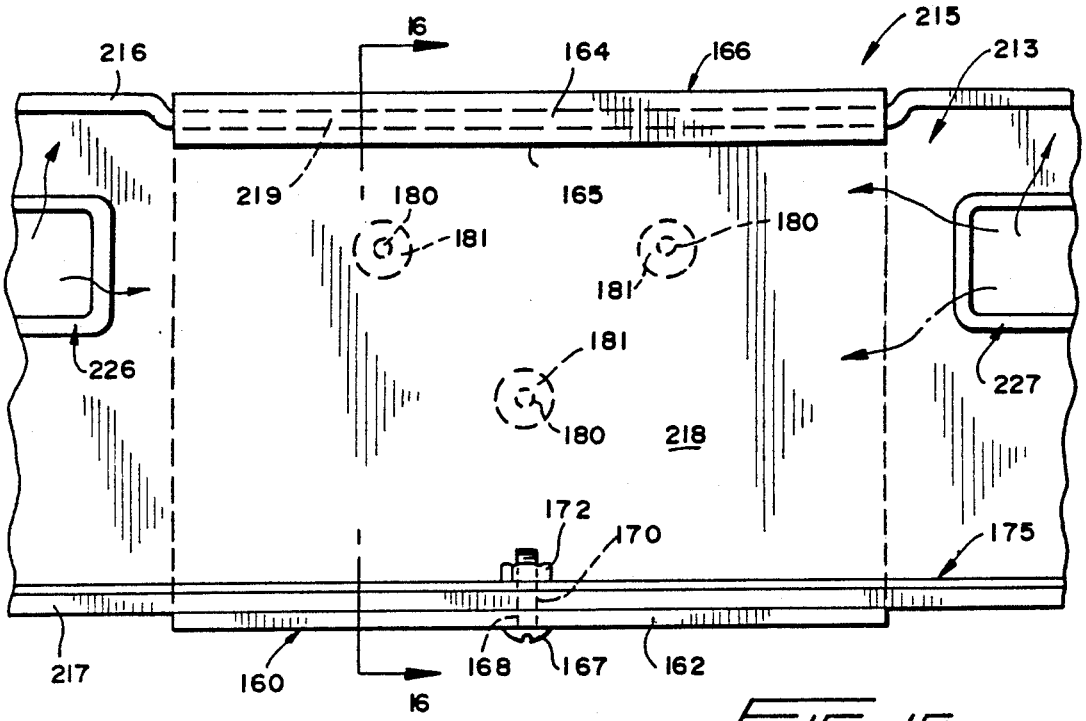
FIG. 15 is a fragmentary top plan view of a primary pan assembly, and illustrates a primary pan and the motor mounting bracket of FIG. 14 secured thereto.
Figure 16:
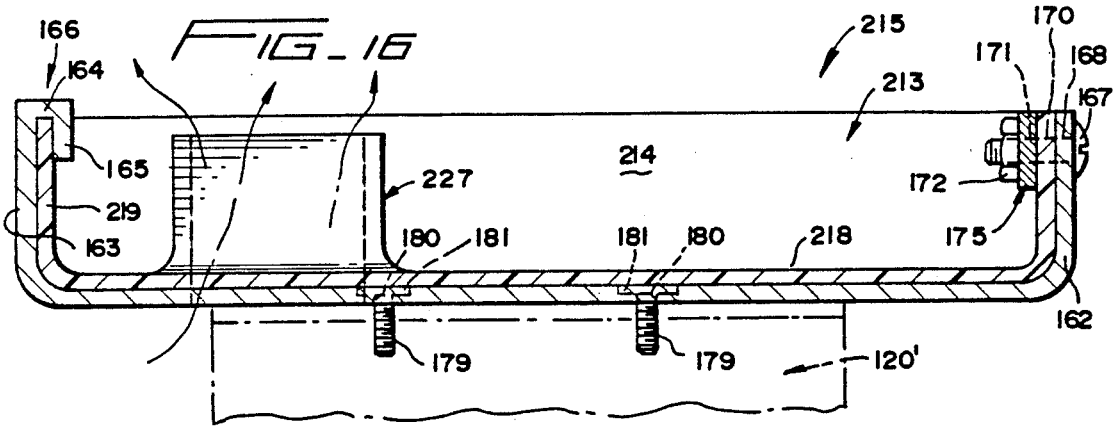
FIG. 16 is a cross-sectional view taken generally along line 16—16 of FIG. 15, and illustrates the details of securing the motor mounting bracket to front and rear walls of the primary pan.
Figure 14:
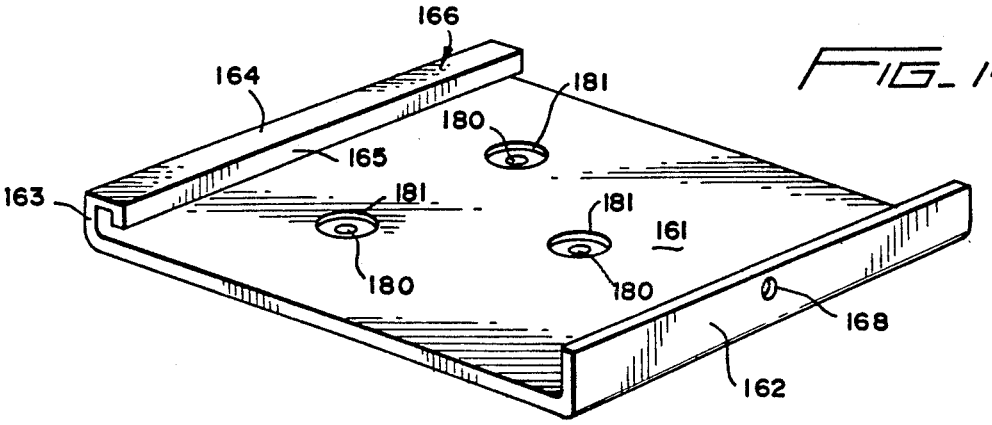
FIG. 14 is a top perspective view, and illustrates another generally U-shaped motor mounting bracket adapted for securement to an exterior of a primary pan.

Reference is now made to FIGS. 14 through 16 of the drawings which illustrate another U-shaped motor mounting bracket 160 (FIG. 14) which is adapted to be secured to a primary pan 213 and defined therewith a primary pan assembly 215. The primary pan 213 is identical to the primary pan 13 and includes opposite lateral walls 214 (only one of which is illustrated in FIG. 16), generally parallel front and rear walls 216, 217, respectively, a bottom wall 218 and two upstanding peripheral walls 226, 227 through which air passes from beneath the bottom 218 in the manner indicated by the unnumbered headed arrows in FIG. 16 and as described heretofore. A portion 219 (FIG. 15) of the front wall 216 is stepped inwardly toward the rear wall 217.

The U-shaped motor mounting bracket 160 is defined by a bight 161 and a pair of legs 162, 163 which are generally parallel to each other and normal to the bight 161. The leg 163 includes an upper wall portion 164 in a downwardly projecting terminal wall portion 165 which collectively define a hook portion 166 of the bracket 160 which is engaged over the offset portion 219 of the front wall 116 in the manner readily apparent in FIG. 16. A fastener 167 passes through an opening 168 in the leg 162 of the bracket 160 and through aligned openings 170, 171 in the rear wall 217 of the primary pan 213 and in a metallic reinforcing member or element 175 which runs the length of the primary pan 213 between the lateral walls 214 thereof. A nut 172 is secured to the fastener or bolt 167 in the manner clearly apparent in FIG. 15 to unit the U-shaped motor mounting bracket 160 to the primary pan 213. Other fasteneing means 167, 172 may be secured between the rear wall 217 and the reinforcing element 175 to rigidify the primary pan 213 along the length thereof.

A motor mounting bracket 120', corresponding to the motor mouting bracket 120 of FIG. 11 can be suitably secured to the motor mounting bracket 160. The latter is preferably achieved by inserting bolts 179 in bores 180 and counterbores 181 of the bight 161 of the bracket 160 in the manner readily apparent from FIGS. 14 through 16 of the drawings. Appropriate nuts (not shown) are secured to the bolts 179 to secure the motor bracket 120' to the bracket 160. Obviously, an important advantage of the U-shaped motor mounting bracket 160 is the fact that the single fastening means 167, 172 is all that is required to assemble the bracket 160 to the primary pan 213, and due to the hook portion 166, the assembly and disassembly can be performed in a rapid and relatively easy fashion.

Figure 17:
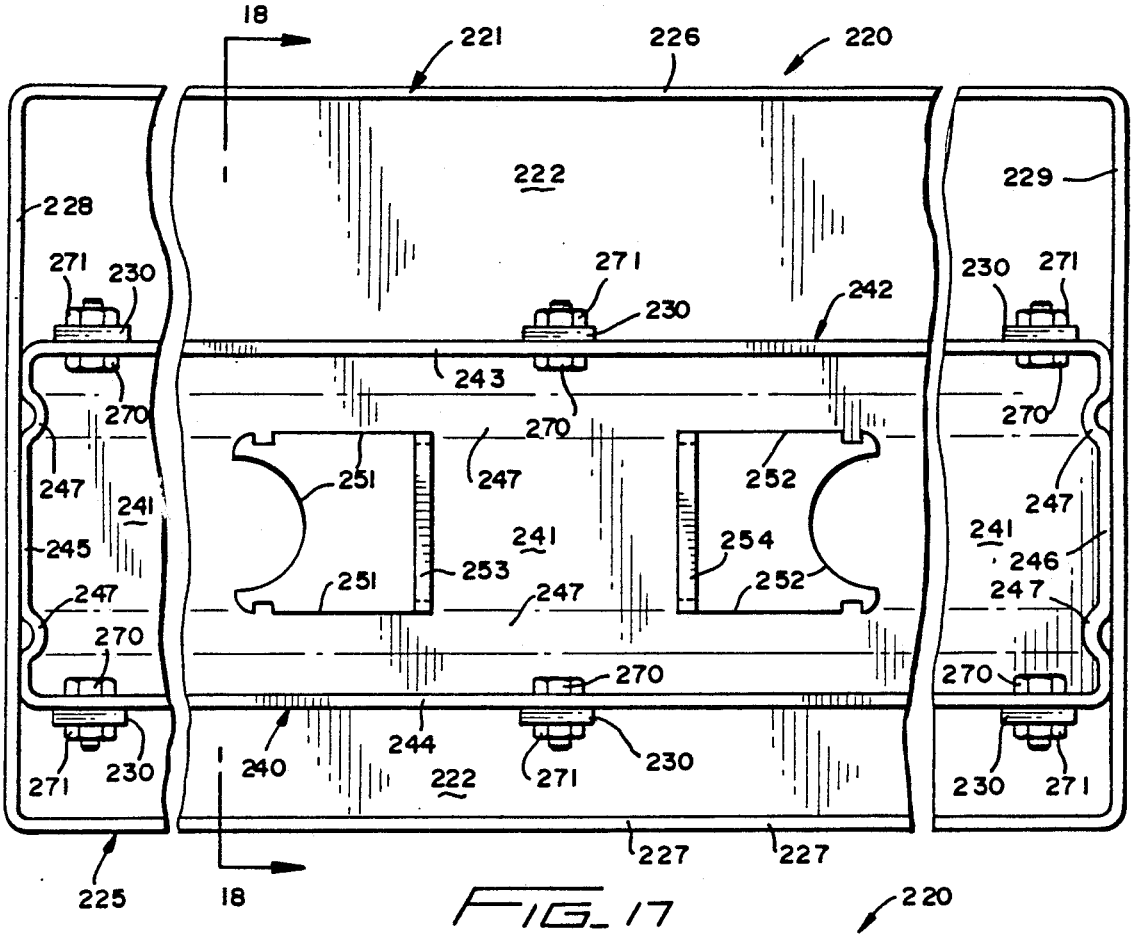
FIG. 17 is a fragmentary bottom plan view of another primary pan assembly, and illustrates a motor mounting bracket secured in underlying reinforcing engagement to a bottom wall of a primary pan.
Figure 18:
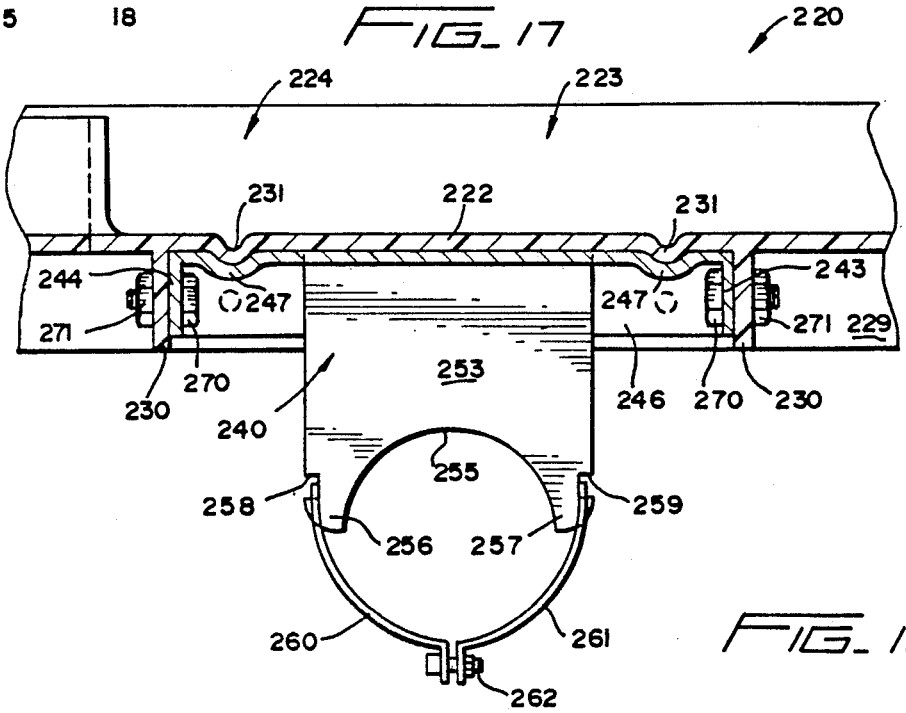
FIG. 18 is a cross-sectional view taken generally along line 18–18 of FIG. 17, and illustrates the manner in which the motor mounting bracket is secured to depending wall portions of the primary pan.

Another primary pan assembly of the present invention is illustrated in FIGS. 17 and 18 of the drawings and is generally designated by the reference numeral 220. The primary pan assembly 220 includes a primary pan 221 which is generally identical to the primary pan 213 and includes a bottom wall 222, an upstanding peripheral wall 223 (FIG. 17) defining a condensation chamber 224 with the bottom wall 222 and a depending peripheral wall 225 defined by depending front and rear walls 226, 227 and lateral walls 228, 229. Also depending from the bottom wall 222 are six identical depending wall portions 230 which are formed integral during the in situ molding of the primary pan 221. The bottom wall 222 also includes two upwardly opening generally parallel reinforcing ribs 231 (FIG. 18) which extend generally along the entire length of the bottom wall 222 between the lateral walls 228, 229. The ribs 231 function to rigidify/reinforce the bottom wall 222 and, thus, the entire primary pan 231 against distortion cold flow, or the like.

Means for mounting a fan motor below the bottom wall 222 is generally designated by the reference 240 and includes a motor moutning bracket defined by an elongated base plate 241 bounded by an integral downwardly projecting or depending peripheral wall 242 which is in turn defined by front and rear walls 243, 244, respectively, and opposite lateral walls 245, 246. A pair of ribs 247 (FIG. 18) are formed in the elongated base plate 241 and match/mate with the ribs 231 of the primary pan bottom wall 222, as is best seen in FIG. 18.

The base plate 241 includes a pair of oppositely directed identical cutouts 251, 252 from which the material struck or cutout is bent upwardly, as viewed in FIG. 17, normal to the base plate 241 to define respective motor mounts 253, 254. As is best viewed in FIG. 18, each of the motor mounts 253, 254 includes a semicircular portion 255 and oppositely directed hooks 256, 257 defined by oppositely outwardly opening notches 258, 259. A conventional motor is positioned upon the semicylindrical surfaces 255 and conventional clamps 260, 261 are assembled thereto as is shown in FIG. 18 through the utilization of the hooks 256, 257 and conventional fasteners 262.

The entire motor mounting bracket 240 is suspendingly secured from the wall portions or tabs 230 by an identical bolt 270 passing through openings (not shown) is peripheral wall 240 and through openings (not shown) in each of the depending walls 230. A nut 271 secured to each fastener or bolt 270 rigidly secures the motor mounting bracket 240 to the underside of the primary pan 221 without, of course, forming any holes whatsoever in the bottom wall 222 or the peripheral walls 223 thereby assuring the integrity of the entire primary pan 221, as well as the rigidity/reinforcement thereof.

Although a preferred embodiment of the invention has been specifically illustrated and described herein, it is to be understood that minor variations may be made in the apparatus without departing from the spirit and scope of the invention, as defined in the appended claims.

I claim:

1. A pan and fan housing assembly for a fan coil unit comprising a primary pan, wall means for defining an air passage in said primary pan through which air is directed from a first side of said primary pan to a second side of said primary pan, a fan housing at said primary pan first side adapted to house a fan therein, said fan housing being formed of at least two fan housing bodies, and means for snap-securing said fan housing bodies to said wall means.

2. The pan and fan housing assembly as defined in claim 1 wherein said wall means includes a periphery edge defining said air passage, and said snap-securing means is snap-secured to said periphery edge.

3. The pan and fan housing assembly as defined in claim 1 wherein said fan housing includes an air inlet and an air outlet, and said air outlet is in telescopic relationship to said wall means.

4. The pan and fan housing assembly as defined in claim 1 wherein said fan housing includes an air inlet and an air outlet, and said air outlet is in internal telescopic relationship to said wall means.

5. The pan and fan housing assembly as defined in claim 1 wherein said fan housing includes an air inlet and an air outlet, said air outlet is defined by a peripheral wall, and said peripheral wall is in telescopic relationship to said air passage.

6. The pan and fan housing assembly as defined in claim 1 comprising means for snap-securing said fan housing bodies to each other.

7. The pan and fan housing assembly as defined in claim 1 wherein said housing bodies each have a peripheral edge, and said housing bodies are in abutment with each other along said peripheral edges.

8. The pan and fan housing assembly as defined in claim 1 wherein said housing bodies each have a peripheral edge, said housing bodies are in abutment with each other along said peripheral edges, and means for snap-securing said fan housing bodies to each other in generally spanning relationship to said abutting peripheral edges.

9. The pan and fan housing assembly as defined in claim 1 wherein said fan housing includes an air inlet and an air outlet, said housing bodies each have a peripheral edge, said housing bodies are in abutment with each other along said peripheral edges, said air inlet includes an axis, and said air inlet is generally normal to a plane through said abutting peripheral edges.

10. The pan and fan housing assembly as defined in claim 1 wherein said housing bodies each have a peripheral edge, said housing bodies are in abutment with each other along said peripheral edges, means for snap-securing said fan housing bodies to each other in generally spanning relationship to said abutting peripheral edges, and said fan housing bodies snap-securing means includes a male fastener of one of said housing bodies received in a female fastener of another of said housing bodies.

11. The pan and fan housing assembly as defined in claim 1 wherein said housing bodies each have a peripheral edge, said housing bodies are in abutment with each other along said peripheral edges, means for snap-securing said fan housing bodies to each other in generally spanning relationship to said abutting peripheral edges, said fan housing bodies snap-securing means includes a male fastener of one of said housing bodies received in a female fastener of another of said housing bodies, said female fastener is an opening, and said male fastener is a hook.

12. The pan and fan housing assembly as defined in claim 1 wherein said housing bodies each have a peripheral edge, said housing bodies are in abutment with each other along said peripheral edges, and said housing body peripheral edges are generally mirror images of each other.

13. The pan and fan housing assembly as defined in claim 1 wherein said housing bodies each have a peripheral edge, said housing bodies are in abutment with each other along said peripheral edges, said housing body peripheral edges are generally mirror images of each other, one of said housing body peripheral edges has a peripheral extending outwardly opening slot formed therein, and another of said housing body peripheral edges has a peripheral extending outwardly projecting tongue received in said slot.

14. The pan and fan housing assembly as defined in claim 1 wherein said wall means is a peripheral wall imparting a configuration to said air passage, said fan housing includes an air inlet and an air outlet, said air outlet is defined by a peripheral wall having a configuration generally corresponding to the configuration of said air passage, and said peripheral walls are disposed in mating relationship.

15. The pan and fan housing assembly as defined in claim 1 wherein said wall means is a peripheral wall imparting a configuration to said air passage, said fan housing includes an air inlet and an air outlet, said air outlet is defined by a peripheral wall having a configuration generally corresponding to the configuration of said air passage, and said peripheral walls are disposed in telescopic mating relationship.

16. The pan and fan housing as defined in claim 1 wherein said primary pan includes a pan body having a bottom wall and an upstanding peripheral wall collectively defining a condensation chamber, said pan body having a front end and a rear end, said pan body having means at said front end for pivotally mounting said pan and fan housing assembly within a fan coil unit, and said pan body having means for preventing pivotal movement of said pan body after said pan and fan housing assembly has been pivotally mounted.

17. The pan and fan housing as defined in claim 1 wherein said primary pan includes a pan body having a bottom wall and an upstanding peripheral wall collectively defining a condensation chamber, said pan body having a front end and a rear end, said pan body having means at said front end for pivotally mounting said pan and fan housing assembly within a fan coil unit, said pan body having means for preventing pivotal movement of said pan body after said pan and fan housing assembly has been pivotally mounted, and said pivotal mounting means includes downwardly opening slot means for pivotally embracing pivot means of an associated fan coil unit.

18. The pan and fan housing as defined in claim 1 wherein said primary pan includes a pan body having a bottom wall and an upstanding peripheral wall collectively defining a condensation chamber, said pan body having a front end and a rear end, said pan body having means at said front end for pivotally mounting said pan and fan housing assembly within a fan coil unit, said pan body having means for preventing pivotal movement of said pan body after said pan and fan housing assembly has been pivotally mounted, and said pivotal mounting means includes a pair of of laterally spaced downwardly opening slots for pivotally embracing pivot means of an associated fan coil unit.

19. The pan and fan housing assembly as defined in claim 1 wherein said fan housing includes an air inlet and an air outlet, said air outlet is defined by a peripheral wall, said peripheral wall is defined by a peripheral wall portion of each of said at least two fan housing bodies, said wall means imparts a configuration to said air passage, and said peripheral wall corresponds in configuration to the configuration of said air passage.

20. The pan and fan housing assembly as defined in claim 5 comprising means for snap-securing said fan housing bodies to each other.

21. The pan and fan housing assembly as defined in claim 5 wherein said housing bodies each have a peripheral edge, and said housing bodies are in abutment with each other along said peripheral edges.

22. The pan and fan housing assembly as defined in claim 5 wherein said housing bodies each have a peripheral edge, said housing bodies are in abutment with each other along said peripheral edges, and means for snap-securing said fan housing bodies to each other in generally spanning relationship to said abutting peripheral edges.

23. The pan and fan housing assembly as defined in claim 5 wherein said fan housing includes an inlet and an air outlet, said housing bodies each have a peripheral edge, said housing bodies are in abutment with each other along said peripheral edges, said air inlet includes an axis, and said air inlet is generally normal to a plane through said abutting peripheral edges.

24. The pan and fan housing assembly as defined in claim 23 comprising means for snap-securing said fan housing bodies to each other.

25. The pan and fan housing assembly as defined in claim 1 wherein said fan housing includes an air inlet and an air outlet, said air outlet is defined by a peripheral wall, said wall means includes a wall in at least partial exterior conforming relationship to said outlet peripheral wall, and said snap-securing means include resilient deflectable wall portions of one of said peripheral wall and said wall means wall snap-secured to the other of said peripheral wall and said wall means wall.

26. The pan and fan housing assembly as defined in claim 25 wherein at least a pair of said resilient deflectable wall portions each carry a locking tongue.

27. The pan and fan housing assembly as defined in claim 26 wherein said locking tongues project generally away from each other.

28. The pan and fan housing assembly as defined in claim 26 wherein said locking tongues project generally away from each other, and said locking tongues are in overlying relationship to one of said peripheral wall and said wall means wall.

29. The pan and fan housing assembly as defined in claim 26 wherein said locking tongues project generally away from each other, said locking tongues are defined by portions of said peripheral wall, and said locking tongues are in overlying relationship to said wall means wall.

* * * * *